US009957824B2

(12) United States Patent
Klinetob et al.

(10) Patent No.: US 9,957,824 B2
(45) Date of Patent: May 1, 2018

(54) VIBRATION DAMPING FOR STRUCTURAL GUIDE VANES

(71) Applicant: United Technologies Corporation, Hartford, CT (US)

(72) Inventors: Carl Brian Klinetob, East Haddam, CT (US); Stephen J. Lindahl, Stuart, FL (US); Myron L. Klein, Higganum, CT (US); Andrew Pope, Glendale, NY (US); William Richard Ganoe, Jr., Vernon, CT (US); Thomas D. Kasprow, Glastonbury, CT (US); Douglas J. Morgan, Glastonbury, CT (US)

(73) Assignee: United Technologies Corporation, Farmington, CT (US)

( * ) Notice: Subject to any disclaimer, the term of this patent is extended or adjusted under 35 U.S.C. 154(b) by 305 days.

(21) Appl. No.: 14/776,473

(22) PCT Filed: Mar. 14, 2014

(86) PCT No.: PCT/US2014/028030
§ 371 (c)(1),
(2) Date: Sep. 14, 2015

(87) PCT Pub. No.: WO2014/143874
PCT Pub. Date: Sep. 18, 2014

(65) Prior Publication Data

US 2016/0333710 A1 Nov. 17, 2016

Related U.S. Application Data

(60) Provisional application No. 61/798,351, filed on Mar. 15, 2013.

(51) Int. Cl.
*F01D 5/16* (2006.01)
*F01D 9/04* (2006.01)
(Continued)

(52) U.S. Cl.
CPC ..... *F01D 9/041* (2013.01); *F01D 5/16* (2013.01); *F01D 5/26* (2013.01); *F01D 25/06* (2013.01);
(Continued)

(58) Field of Classification Search
CPC ..... F01D 5/16; F01D 5/26; F01D 5/28; F01D 25/06; F05D 2240/123; F05D 2240/124; F05D 2260/96
See application file for complete search history.

(56) References Cited

U.S. PATENT DOCUMENTS 2,862,686 A 12/1958 Bartlett
3,606,580 A * 9/1971 Kaufman ..... B21H 7/16 416/232
(Continued)

FOREIGN PATENT DOCUMENTS

EP 1596036 A1 11/2005
JP 2011064321 A 3/2011

OTHER PUBLICATIONS

International Search Report and Written Opinion from PCT Application Serial No. PCT/US2014/028030, dated Jul. 10, 2014, 13 pages.
(Continued)

*Primary Examiner* — Ninh H Nguyen
(74) *Attorney, Agent, or Firm* — Kinney & Lange, P.A.

(57) ABSTRACT

A stationary guide vane includes a top platform, a bottom platform, and a vane body located between the top platform and the bottom platform. The vane body includes one or more cavities formed on a side wall of the vane body. One or more of the cavities are filled with vibration damping material and a vane cover is bonded to the vane body over the one or more containers.

14 Claims, 4 Drawing Sheets

(51) Int. Cl.
*F01D 5/26* (2006.01)
*F01D 25/06* (2006.01)

(52) U.S. Cl.
CPC ..... *F05D 2230/60* (2013.01); *F05D 2240/12* (2013.01); *F05D 2240/123* (2013.01); *F05D 2240/124* (2013.01); *F05D 2260/96* (2013.01); *F05D 2300/121* (2013.01); *F05D 2300/171* (2013.01)

(56) References Cited

U.S. PATENT DOCUMENTS 5,056,738 A 10/1991 Mercer et al.
5,141,400 A 8/1992 Murphy et al.
5,284,011 A * 2/1994 Von Benken ..... F01D 5/26 248/554
5,356,264 A * 10/1994 Watson ..... F01D 25/04 415/119
5,498,137 A 3/1996 El-Aini et al.
5,725,355 A 3/1998 Crall et al.
5,947,688 A 9/1999 Schilling et al.
6,033,186 A 3/2000 Schilling et al.
6,039,542 A 3/2000 Schilling et al.
6,551,057 B1 4/2003 Haaser et al.
6,669,447 B2 12/2003 Norris et al.
6,979,180 B2 12/2005 Motherwell
7,980,813 B2 7/2011 Medynski et al.
8,177,513 B2 * 5/2012 Shim ..... B23P 15/04 29/889.7
2005/0254955 A1 * 11/2005 Helder ..... B23K 20/122 416/233
2006/0263222 A1 11/2006 Vetters
2008/0072569 A1 3/2008 Moniz et al.
2008/0253885 A1 * 10/2008 Foose ..... F01D 5/147 415/208.2
2010/0209235 A1 8/2010 Shim et al.
2010/0329847 A1 12/2010 Yamashita et al.
2011/0211965 A1 9/2011 Deal et al.

OTHER PUBLICATIONS

Extended European Search Report for EP Application No. 14765779.5, dated Dec. 22, 2016, 6 Pages.

* cited by examiner

VIBRATION DAMPING FOR STRUCTURAL GUIDE VANES

BACKGROUND

The present invention is related to structural guide vanes (SGVs), and in particular to vibration damping for SGVs.

SGVs are employed in aircraft engines to control and guide the flow of air through the engine. SGVs may be employed both in the compressor and turbine stages of the aircraft engine, and are subject to various loads and vibratory forces. The design of SGVs represents a trade-off between robustness of the SGV and weight of the guide vane. That is, larger vibratory loads are accommodated by increasing the size of the SGVs, at the expense of greater weight.

SUMMARY

A stationary guide vane includes a top platform, a bottom platform, and a vane body located between the top platform and the bottom platform. The vane body includes one or more cavities formed on a side wall of the vane body. One or more of the cavities are filled with vibration damping material and a vane cover is bonded to the vane body over the one or more containers.

DETAILED DESCRIPTION

Figure 1:
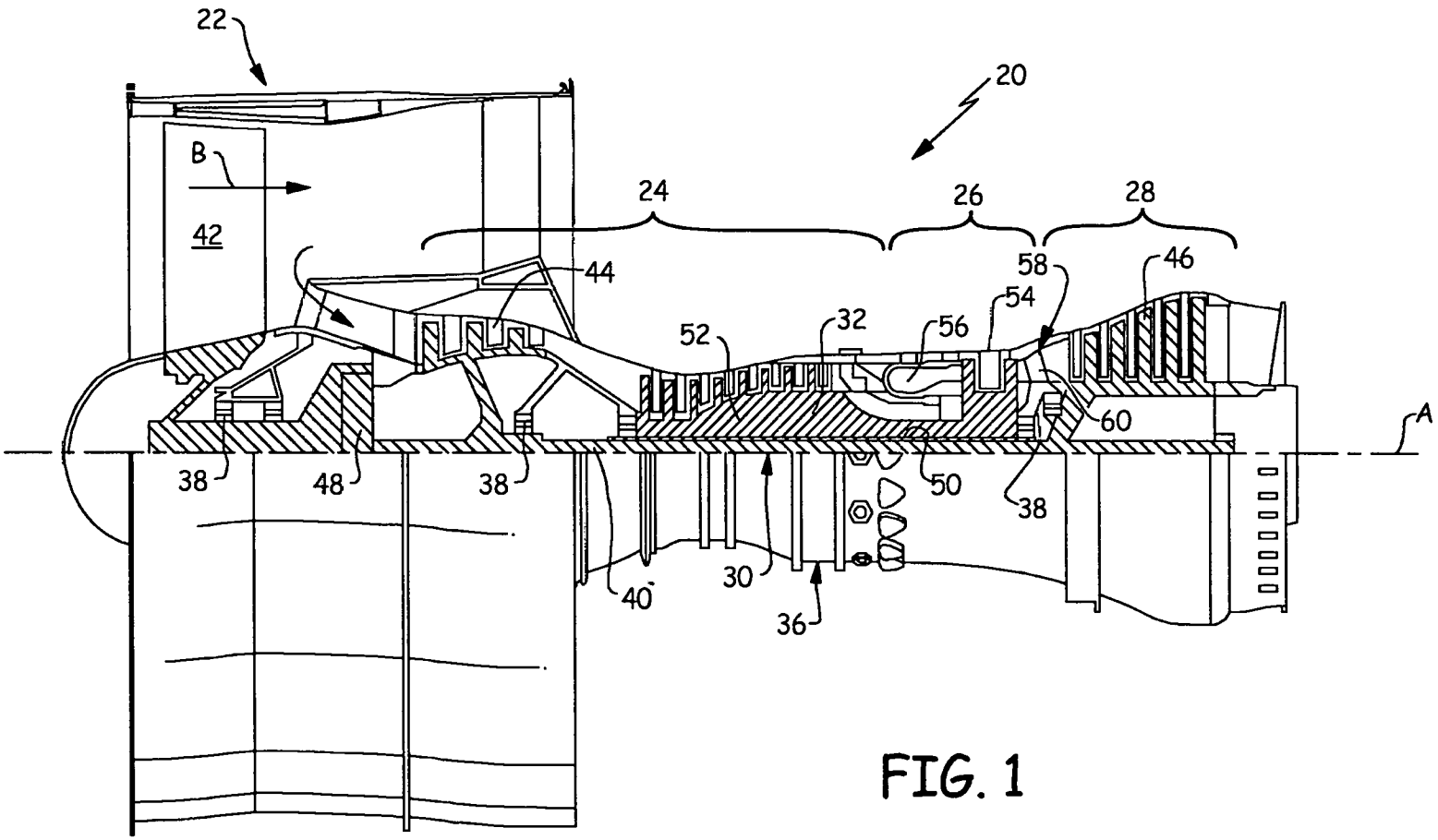
FIG. 1 is a schematic view of a gas turbine engine according to an embodiment of the present invention.

FIG. 1 schematically illustrates an example gas turbine engine 20 that includes fan section 22, compressor section 24, combustor section 26 and turbine section 28. Alternative engines might include an augmenter section (not shown) among other systems or features. Fan section 22 drives air along bypass flow path B while compressor section 24 draws air in along core flow path C where air is compressed and communicated to combustor section 26. In combustor section 26, air is mixed with fuel and ignited to generate a high pressure exhaust gas stream that expands through turbine section 28 where energy is extracted and utilized to drive fan section 22 and compressor section 24.

Although the disclosed non-limiting embodiment depicts a turbofan gas turbine engine, it should be understood that the concepts described herein are not limited to use with turbofans as the teachings may be applied to other types of turbine engines; for example a turbine engine including a three-spool architecture in which three spools concentrically rotate about a common axis and where a low spool enables a low pressure turbine to drive a fan via a gearbox, an intermediate spool that enables an intermediate pressure turbine to drive a first compressor of the compressor section, and a high spool that enables a high pressure turbine to drive a high pressure compressor of the compressor section.

The example engine 20 generally includes low speed spool 30 and high speed spool 32 mounted for rotation about an engine central longitudinal axis A relative to an engine static structure 36 via several bearing systems 38. It should be understood that various bearing systems 38 at various locations may alternatively or additionally be provided.

Low speed spool 30 generally includes inner shaft 40 that connects fan 42 and low pressure (or first) compressor section 44 to low pressure (or first) turbine section 46. Inner shaft 40 drives fan 42 through a speed change device, such as geared architecture 48, to drive fan 42 at a lower speed than low speed spool 30. High-speed spool 32 includes outer shaft 50 that interconnects high pressure (or second) compressor section 52 and high pressure (or second) turbine section 54. Inner shaft 40 and outer shaft 50 are concentric and rotate via bearing systems 38 about engine central longitudinal axis A.

Combustor 56 is arranged between high pressure compressor 52 and high pressure turbine 54. In one example, high pressure turbine 54 includes at least two stages to provide a double stage high pressure turbine 54. In another example, high pressure turbine 54 includes only a single stage. As used herein, a "high pressure" compressor or turbine experiences a higher pressure than a corresponding "low pressure" compressor or turbine.

The example low pressure turbine 46 has a pressure ratio that is greater than about 5. The pressure ratio of the example low pressure turbine 46 is measured prior to an inlet of low pressure turbine 46 as related to the pressure measured at the outlet of low pressure turbine 46 prior to an exhaust nozzle.

Mid-turbine frame 58 of engine static structure 36 is arranged generally between high pressure turbine 54 and low pressure turbine 46. Mid-turbine frame 58 further supports bearing systems 38 in turbine section 28 as well as setting airflow entering low pressure turbine 46.

The core airflow C is compressed by low pressure compressor 44 then by high pressure compressor 52 mixed with fuel and ignited in combustor 56 to produce high speed exhaust gases that are then expanded through high pressure turbine 54 and low pressure turbine 46. Mid-turbine frame 58 includes vanes 60, which are in the core airflow path and function as an inlet guide vane for low pressure turbine 46. Utilizing vane 60 of mid-turbine frame 58 as the inlet guide vane for low pressure turbine 46 decreases the length of low pressure turbine 46 without increasing the axial length of mid-turbine frame 58. Reducing or eliminating the number of vanes in low pressure turbine 46 shortens the axial length of turbine section 28. Thus, the compactness of gas turbine engine 20 is increased and a higher power density may be achieved.

The disclosed gas turbine engine 20 in one example is a high-bypass geared aircraft engine. In a further example, gas turbine engine 20 includes a bypass ratio greater than about six (6), with an example embodiment being greater than about ten (10). The example geared architecture 48 is an epicyclical gear train, such as a planetary gear system, star gear system or other known gear system, with a gear reduction ratio of greater than about 2.3.

In one disclosed embodiment, gas turbine engine 20 includes a bypass ratio greater than about ten (10:1) and the fan diameter is significantly larger than an outer diameter of low pressure compressor 44. It should be understood, however, that the above parameters are only exemplary of one embodiment of a gas turbine engine including a geared architecture and that the present disclosure is applicable to other gas turbine engines.

A significant amount of thrust is provided by bypass flow B due to the high bypass ratio. Fan section 22 of engine 20 is designed for a particular flight condition—typically cruise at about 0.8 Mach and about 35,000 feet. The flight condition of 0.8 Mach and 35,000 ft., with the engine at its best fuel consumption—also known as "bucket cruise Thrust Specific Fuel Consumption ('TSFC')"—is the industry standard parameter of pound-mass (lbm) of fuel per hour being burned divided by pound-force (lbf) of thrust the engine produces at that minimum point.

"Low fan pressure ratio" is the pressure ratio across the fan blade alone, without a Fan Exit Guide Vane ("FEGV") system. The low fan pressure ratio as disclosed herein according to one non-limiting embodiment is less than about 1.50. In another non-limiting embodiment the low fan pressure ratio is less than about 1.45.

"Low corrected fan tip speed" is the actual fan tip speed in ft/sec divided by an industry standard temperature correction of $[(\text{Tram}\ ^\circ\text{R})/518.7)^{0.5}]$. The "Low corrected fan tip speed", as disclosed herein according to one non-limiting embodiment, is less than about 1150 ft/second.

The example gas turbine engine includes fan 42 that comprises in one non-limiting embodiment less than about 26 fan blades. In another non-limiting embodiment, fan section 22 includes less than about 20 fan blades. Moreover, in one disclosed embodiment low pressure turbine 46 includes no more than about 6 turbine rotors schematically indicated at 34. In another non-limiting example embodiment low pressure turbine 46 includes about 3 turbine rotors. A ratio between number of fan blades 42 and the number of low pressure turbine rotors is between about 3.3 and about 8.6. The example low pressure turbine 46 provides the driving power to rotate fan section 22 and therefore the relationship between the number of turbine rotors 34 in low pressure turbine 46 and number of blades 42 in fan section 22 disclose an example gas turbine engine 20 with increased power transfer efficiency.

Figure 2:
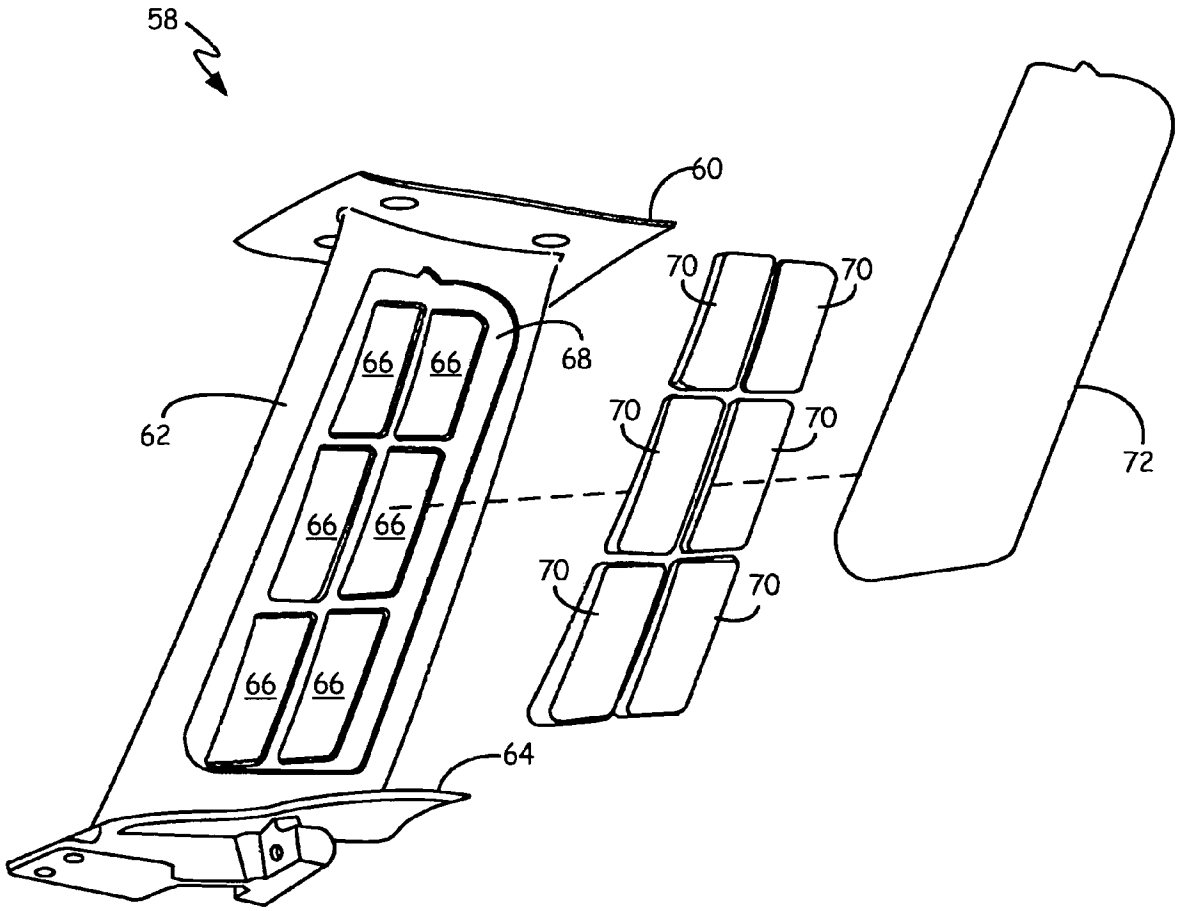
FIG. 2 is an orthogonal view of a stationary guide vane (SGV) according to an embodiment of the present invention.

FIG. 2 is an exploded view of stationary guide vane (SGV) 58 according to an embodiment of the present invention. SGV 58 includes top platform 60, vane body 62, and bottom platform 64. Top platform 60 is mounted to an outer case (not shown). Likewise, bottom platform 64 is mounted to an inner hub (not shown). Vane body 62 is located between top platform 60 and bottom platform 64, and includes a plurality of cavities 66 formed in the side of vane body 62. In the embodiment shown in FIG. 2, cavities 66 are rectangular in shape. The number and location of cavities 66 may vary depending on the application. Cavities 66 may be formed on one or both sides of SGV 58, depending on the depth of SGV 58 and the depth of cavities 66.

Each of the plurality of cavities 66 receives a container 70. The shape of each container 70 is selected to fit within the geometry of each cavity 66. For example, in the embodiment shown in FIG. 2, each container 70 is rectangular to fit within rectangular-shaped cavities 66. In other embodiments, various other geometries may be employed by the plurality of cavities 66 and containers 70.

Vibration damping is provided by material loaded into each of the plurality of containers 70. That is, each container 70 is hollow, and prior to installation in SGV 58 is filled with a vibration damping material. In one embodiment, the vibration damping material is stainless steel balls (e.g., shots), wherein the purpose of container 70 is to protect SGV 58 from damage caused by movement of the vibration damping material. The amount of vibration damping provided by the plurality of containers 70 is dependent on the number of containers 70 employed, the placement of containers 70 within SGV 58, and the fill-level of each container 70. Increasing the number of containers 70 increases the amount of vibration damping provided, but must be balanced with the structural integrity of SGV 58. Placing the plurality of containers 70 at points of maximum inflection associated with SGV 58 also increases the amount of vibration damping provided. Lastly, filling the plurality of containers 70 to a fill level that is less than 100% increases the vibration damping provided. For example, in one embodiment a fill level of approximately 90% is employed to provide desired the desired vibration damping.

Containers 70 are bonded within cavities 66, and vane cover 72 is bonded within cavity 68 to provide additional structural support. The placement of vane cover 72 provides a uniform or flat outer surface of SGV 58, to provide the desired airflow characteristics.

Figure 3:
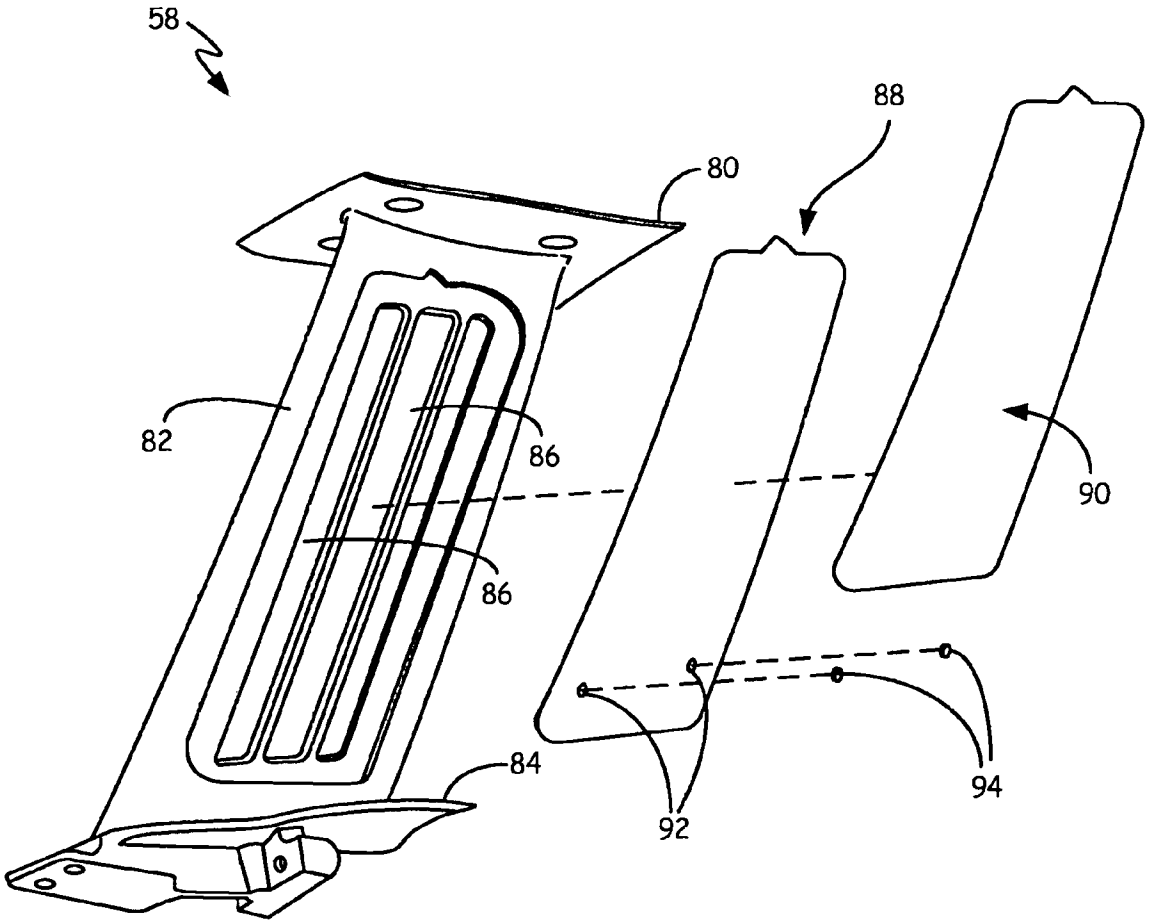
FIG. 3 is an orthogonal view of a stationary guide vane (SGV) according to another embodiment of the present invention.

FIG. 3 is an exploded view of stationary guide vane (SGV) 78 according to an embodiment of the present invention. SGV 78 includes top platform 80, vane body 82, and bottom platform 84. Top platform 80 is mounted to an outer case (not shown). Likewise, bottom platform 84 is mounted to an inner hub (not shown). Vane body 82 is located between top platform 80 and bottom platform 84, and includes a plurality of cavities 86 formed in the side of vane body 82. In the embodiment shown in FIG. 2, cavities 86 are rectangular in shape and extend along a length of vane body 82. In other embodiments, the number, location and geometry of cavities 86 may vary depending on the application. Cavities 86 may be formed on one or both sides of SGV 78, depending on the depth of SGV 78 and the depth of cavities 86. First cover 88 is secured to vane body 82 to retain vibration damping material (not shown) within cavities 86. In one embodiment, second cover 90 is bonded over first cover 88.

In contrast with the embodiment shown in FIG. 2, in which containers filled with vibration damping material are bonded to the cavities, in the embodiment shown in FIG. 2 the vibration damping material is provided directly to cavities 86. The vibration damping material (not shown), is held in place by first cover 88. In one embodiment, first cover 88 is bonded to vane body 82 before vibration damping material is added to cavities 86. After bonding first cover 88 to vane body 82, one or more holes 92 (pre-drilled, or drilled after installation of first cover 92) are utilized to fill cavities 86 with vibration damping material (e.g., steel shot). Holes 92 are covered with coverings 94, which in one embodiment are comprised of flashbreaker tape. Second cover 90 is bonded to first cover 88.

As discussed with respect to the embodiment shown in FIG. 2, in one embodiment, the vibration damping material is stainless steel balls (e.g., shots), wherein the purpose of vibration damping material is to protect SGV 78 from damage caused by movement of the vibration damping material. The amount of vibration damping provided by the vibration damping material is dependent on the amount of vibration damping material provided to cavities 86, the type of vibration damping material employed, and the cavities selected to receive vibration damping material. In one embodiment, vibration damping material is added to cavities in regions that experience the most vibration or inflection during operation. For example, in one embodiment (shown in FIG. 4 below) vibration damping material is provided to outside cavities, but no vibration damping material is provided to the central cavity. The decision of whether to add vibration damping material to a particular cavity is a cost-benefit analysis of the vibration damping provided by the vibration damping material versus the added weight associated with the vibration damping material. In some embodiments, it may be beneficial to add vibration damping material to all cavities, while in others it may be beneficial to add vibration damping material to select cavities, such as those located in areas that experience maximum inflection. In addition, as described with respect to FIG. 2, vibration damping is improved by maintaining the fill level of the vibration damping material to a level less than 100%. For example, in one embodiment a fill level of approximately 90% is employed to provide desired the desired vibration damping.

In addition to selection of and placement of vibration damping material, various materials may be utilized to form vane body 82, first cover 88, and second cover 90. For example, in one embodiment vane body 82, first cover 88, and second cover 90 are formed of the same material, such as aluminum. In other embodiments, vane body 82, first cover 88 and second cover 90 may be formed of different materials to vary performance parameters of the SGV 78, such as weight and/or stiffness.

Figure 4:
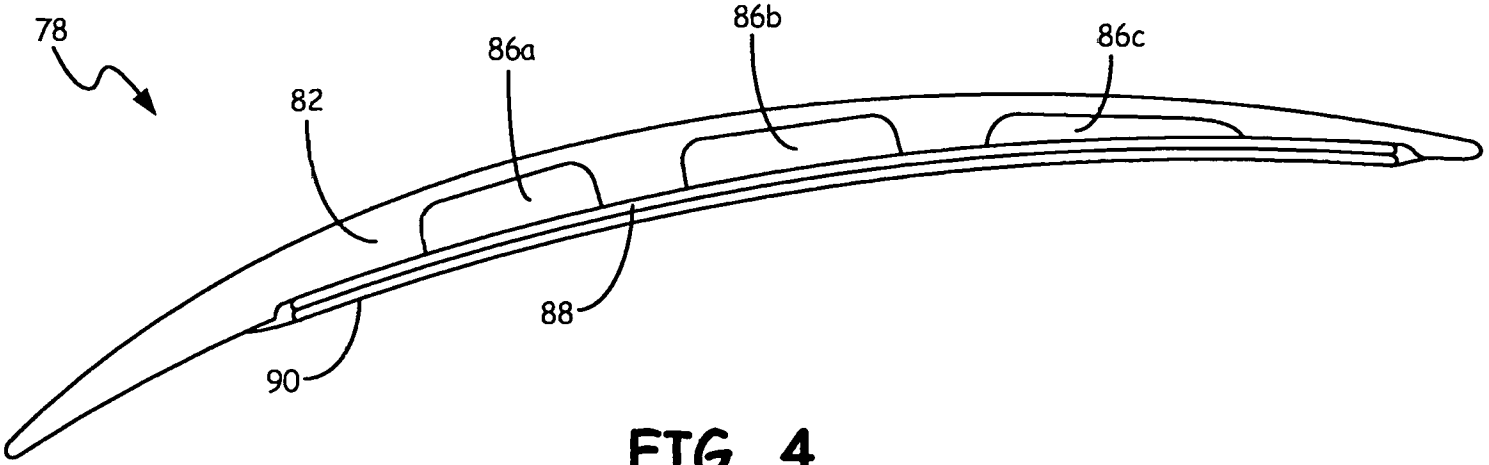
FIG. 4 is a top view of a stationary guide vane according to an embodiment of the present invention.

FIG. 4 is a top view of SGV 78 that excludes top platform 80 and illustrates the location of cavities 86 (labeled '86*a*', '86*b*', and '86*c*') within vane body 82. In the embodiment shown in FIG. 4, cavities 86*a*, 86*b*, and 86*c* are formed on one side of vane body 82. In the embodiment shown in FIG. 4, only cavities 86*a* and 86*c* are filled with vibration damping material, with cavity 86*b* left unfilled. First cover 88 is bonded to vane body 82 to retain vibration damping material within cavities 86*a* and 86*c*, and second cover 90 is bonded to first cover 88.

The following are non-exclusive descriptions of possible embodiments of the present invention.

A stationary guide vane (SGV) according to an exemplary embodiment of this disclosure includes a top platform, a bottom platform, and a vane body located between the top platform and the bottom platform. The vane body includes one or more cavities formed on a side wall of the vane body. One or more containers filled with a vibration damping material are bonded within the one or more cavities. A vane cover is bonded to the vane body over the one or more containers.

In a further embodiment, the SGV may utilize steel shot as the vibration damping material.

In a further embodiment of any of the foregoing embodiments, the containers bonded to the cavities may be filled to a level less than 100% filled with vibration damping material.

In a further embodiment of any of the foregoing embodiments, the containers may be filled to a level of approximately 90%.

In a further embodiment of any of the foregoing embodiments, the containers may be located in the vane body at a point of maximum inflection on the stationary guide vane.

In a further embodiment of any of the foregoing embodiments, the vane body may be aluminum.

A stationary guide vane (SGV) according to an exemplary embodiment of this disclosure includes a top platform, a bottom platform, a vane body located between the top platform and the bottom platform, one or more containers and a vane cover. The vane body includes one or more cavities formed on a sidewall of the vane body. The one or more containers are filled with a vibration damping material to level equal to or less than 90%, and bonded within the one or more cavities formed in the vane body. The vane cover is bonded to the vane body over the one or more containers.

In a further embodiment, the vibration damping material may be steel shots.

In a further embodiment of any of the foregoing embodiments, the one or more containers may be located in the vane body at a point of maximum inflection.

In a further embodiment of any of the foregoing embodiments, the vane body may be constructed of aluminum.

A stationary guide vane according to an exemplary embodiment of this disclosure includes a top platform, a bottom platform, a vane body located between the top platform and the bottom platform, and a vane cover. The vane body includes one or more cavities formed on a side wall of the vane body, wherein vibration damping material is located in one or more of the cavities. The vane cover is bonded to the vane body to retain the vibration damping material within the cavity.

In a further embodiment, the vibration damping material is formed of steel shot.

In a further embodiment, the cavities are filled with the vibration damping material to a level less than 100% filled.

In a further embodiment, the cavities are filled with the vibration damping material to a level of approximately 90%.

In a further embodiment, the one or more of the cavities remains unfilled with vibration damping material.

In a further embodiment, the vane cover includes one or more holes for supplying the vibration damping material to the one or more cavities after bonding of the vane cover to the vane body.

In a further embodiment, the stationary guide vane further includes a second vane cover that is bonded to the vane cover after the vibration damping material has been supplied to the one or more cavities.

While the invention has been described with reference to an exemplary embodiment(s), it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment(s) disclosed, but that the invention will include all embodiments falling within the scope of the appended claims.

The invention claimed is:

1. A stationary guide vane comprising:

a top platform;

a bottom platform;

a vane body located between the top platform and the bottom platform, wherein the vane body includes one or more cavities formed on a side wall of the vane body;

one or more containers filled with a vibration damping material and bonded within the one or more cavities formed in the vane body; and a vane cover bonded to the vane body over the one or more containers;

wherein the vibration damping material is steel shot.

2. The stationary guide vane of claim 1, wherein the one or more containers are filled with the vibration damping material to a level less than 100% filled.

3. The stationary guide vane of claim 2, wherein the one or more containers are filled with the vibration damping material to a level of approximately 90%.

4. The stationary guide vane of claim 1, wherein the one or more containers are located in the vane body at a point of maximum inflection of the stationary guide vane.

5. The stationary guide vane of claim 1, wherein the vane body is aluminum.

6. A stationary guide vane comprising:

a top platform;

a bottom platform;

a vane body located between the top platform and the bottom platform, wherein the vane body includes one or more cavities formed on a side wall of the vane body;

one or more containers filled with a vibration damping material to a level equal to or less than 90%, and bonded within the one or more cavities formed in the vane body; and a vane cover bonded to the vane body over the one or more containers;

wherein the vibration damping material is steel shot.

7. The stationary guide vane of claim 6, wherein the one or more containers are located in the vane body at a point of maximum inflection.

8. The stationary guide vane of claim 6, wherein the vane body is aluminum.

9. A stationary guide vane comprising:

a top platform;

a bottom platform;

a vane body located between the top platform and the bottom platform, wherein the vane body includes one or more cavities formed on a side wall of the vane body, wherein vibration damping material is located in one or more of the cavities; and a vane cover bonded to the vane body over the one or more cavities;

wherein the vibration damping material is steel shot.

10. The stationary guide vane of claim 9, wherein the cavities are filled with the vibration damping material to a level less than 100% filled.

11. The stationary guide vane of claim 10, wherein the cavities are filled with the vibration damping material to a level of approximately 90%.

12. The stationary guide vane of claim 9, wherein one or more of the cavities remains unfilled with vibration damping material.

13. The stationary guide vane of claim 9, wherein the vane cover includes one or more holes for supplying the vibration damping material to the one or more cavities after bonding of the vane cover to the vane body.

14. The stationary guide vane of claim 13, further including a second vane cover that is bonded to the vane cover after the vibration damping material has been supplied to the one or more cavities.

* * * * *